US007887872B2

(12) United States Patent
Viitanen et al.

(10) Patent No.: US 7,887,872 B2
(45) Date of Patent: Feb. 15, 2011

(54) METHOD AND APPARATUS FOR SEPARATING IMPURITIES FROM MACHINE CIRCULATION OF COATING STATION

(75) Inventors: Markku Viitanen, Valkeakoski (FI); Ilkka Roitto, Masku (FI)

(73) Assignee: Metso Paper, Inc., Helsinki (FI)

( * ) Notice: Subject to any disclaimer, the term of this patent is extended or adjusted under 35 U.S.C. 154(b) by 1000 days.

(21) Appl. No.: 11/575,472

(22) PCT Filed: Sep. 20, 2005

(86) PCT No.: PCT/FI2005/000395

§ 371 (c)(1),
(2), (4) Date: Mar. 16, 2007

(87) PCT Pub. No.: WO2006/032722

PCT Pub. Date: Mar. 30, 2006

(65) Prior Publication Data

US 2009/0181176 A1 Jul. 16, 2009

(30) Foreign Application Priority Data

Sep. 21, 2004 (FI) ..... 20041219

(51) Int. Cl.
*B01D 37/04* (2006.01)
*B05C 11/10* (2006.01)

(52) U.S. Cl. ..... 427/8; 427/345; 118/603; 118/610; 210/741; 210/744; 210/784; 210/97; 210/137; 210/251; 210/262; 210/402

(58) Field of Classification Search ..... None
See application file for complete search history.

(56) References Cited

U.S. PATENT DOCUMENTS

| | | | | |
|---|---|---|---|---|
| 6,074,700 | A * | 6/2000 | Roitto | 427/345 |
| 6,358,558 | B1 * | 3/2002 | Viitanen | 427/8 |
| 2009/0181176 | A1 * | 7/2009 | Viitanen et al. | 427/345 |

FOREIGN PATENT DOCUMENTS

| | | | |
|---|---|---|---|
| EP | 733734 | A2 * | 9/1996 |
| EP | 960980 | A1 * | 12/1999 |
| JP | 2000017599 | A | 1/2000 |
| JP | 2000017599 | A * | 1/2000 |
| JP | 2003265909 | A | 9/2003 |
| JP | 2003265909 | A * | 9/2003 |
| WO | WO 2006032722 | A1 * | 3/2006 |

OTHER PUBLICATIONS

Japanese Office action in Pat. App. No. 2007-531782.

* cited by examiner

*Primary Examiner*—Robert James Popovics
(74) *Attorney, Agent, or Firm*—Stiennon & Stiennon

(57) ABSTRACT

Method and arrangement for separating impurities from the machine circulation of a processing agent of a processing station used in processing paper or board, in which method the processing agent is led from a reservoir (1) to the processing station (2), where it is spread on the surface of the web being processed, and the excess processing agent led to the processing station (2) agent is led back to the reservoir (1). The flow of processing agent coming from the processing station (2) is led to at least one pressure sieve (6), which is located below the level of the processing station (2), in such a way that the feed pressure of the processing agent is created on the basis of the difference in height between the station (2) and the pressure sieve (6).

14 Claims, 1 Drawing Sheet

METHOD AND APPARATUS FOR SEPARATING IMPURITIES FROM MACHINE CIRCULATION OF COATING STATION

CROSS REFERENCES TO RELATED APPLICATIONS

This application is a U.S. national stage application of international App. No. PCT/FI2005/000395, filed Sep. 20, 2005, the disclosure of which is incorporated by reference herein, and claims priority on FI 20041219, filed Sep. 21, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for separating impurities from the machine circulation of the mixture circulating through the coating station, of coating stations used in the coating and sizing of paper and board.

The invention also relates to an arrangement intended to apply the method.

At a coating station or a sizing station, coating is spread by an application device on the paper or board web to be coated and the coating layer is leveled to the set thickness using a doctor device. The application device usually spreads a large excess amount of coating and in many application devices a so-called return flow is used, which does not adhere to the web. The return flow of the application device and the excess doctored from the web are returned to the coating machine reservoir, from where the coating is pumped to the coating station. The coating pumped to the coating station must be clean, so that there is a pressure sieve in the machine circulation between the feed pump and the station, by means of which impurities brought with the web, pieces of paper that have entered the circulation from a web break, and possible lumps of hardened coating that have formed are removed from the coating. The sieves used are mainly washable sieves operating on the back-wash principle, or sieves made by coiling a triangular wire, which are kept clean by a mechanical doctor. Back-wash sieves are being withdrawn from use, because a considerable amount of waste water with a coating content arises in the washing of the sieve, which loads the mill's water-treatment system. The raw-material losses of washable sieves are greater than those of mechanically cleaned sieves.

Mechanically cleaned sieves are closed pressurized vessels, in which the coating travels through the sieving element from a higher pressure to a lower pressure. The sieving element can be either a perforated plate, or a cylinder wound from a single triangular wire, in which a gap for penetration is formed between the wire windings. The gap width of the wire drum is about 75-150 μm and its length is very great, because a single gap forms a sieving surface over the entire length of the wire. The sieve is cleaned by moving a doctor element over the surface of the sieve cylinder and the reject that collects in the sieve is removed by opening the reject valve at intervals of, for example, 8 hours. From the reject valve, a few tens of liters (10-30 l) of coating is released and led into the mill's drainage system. Although such pressure sieves have a large sieving capacity relative to the sieving surface area, the size of the gap means that they cannot effectively separate long fibrous impurities. Fibrous impurities collect in the machine circulation of the coating stations and, when they become caught under the coating station's doctor element, cause streaks in the coating and thus spoil the paper being manufactured. Another drawback caused by fibrous impurities is blockage of the sieve gap when elongated fibers become caught in it. The elongated fibers become oriented parallel to the flow, so that they either so through the gap or become jammed in it. Long fibers enter the machine circulation from the coating return circulation and are formed of fibers that have detached from the web being coated and of synthetic fibers that have detached to the surface of the web from the drying felt, and which in turn detach from the web during coating. These impurities cause most of the need to service and clean the sieve, so that it would be important to remove them from the machine circulation. A drawback with mechanically cleaned pressure sieves is still the large amount of reject coating that loads the cleaning devices, because usually there are several sieves in a coating line and tens of liters of reject must be removed from each one about three times each day.

If perforated plates are used as the sieving elements, the fibrous impurities can be removed quite well. The drawback with these sieves is, however, a considerably lower capacity than gap sieves of a corresponding hole size. If the width of the gap of a gap sieve is 150 μm, it can be used to achieve a sieving capacity of about 40 l/s. Using a plate sieve with a corresponding hole seize, a capacity of about 15 l/s can be achieved. Thus at large flows more perforated-plate sieves will be required, or else they can be used to process only some of the circulating flow.

A drawback in sieving carried out on the high-pressure side of the coating station is still the fact that, because the coating-agent reservoir, which is below the machine level, of the coating station or sizing station is considerably lower than the station itself, the pressure of the mixture must be raised considerably. Thus the pressure over the sieve may be as much as 2-6 bar, whereas it only needs to be 0.1-0.2 bar over the sieve to operate. This means that on the feed side of the coating station a high-efficiency feed pump is required, as well as piping, sieves, and air bleeds that are designed to withstand a high pressure. When operating at a high pressure, the soft impurities collapse and may then pass through the sieve drum and even threaten to break the sieve drum. On the other hand, the return pipe of the coating station is often partly empty, because it is dimensioned for the largest flow used and there are no devices that cause flow resistance, prior to the machine reservoir. When the pipe is empty, coating agent may be precipitated in it, which must be cleaned or which may start moving into the machine circulation.

In order to remove fibers that have entered the machine circulation, the mixture returning from the coating station have been at least partly sieved with oscillating sieves. However, oscillating sieves have such a limited capacity that the full return flow cannot be sieved without increasing the number of oscillating sieves unreasonably, or by reducing their separation ability by using sieving elements with larger openings. Oscillating sieve also have the drawback that a large amount of air penetrates the coating mixture that falls under the sieve fabric as drops. This form of sieving is mainly used to sieve the small amount of mixture that circulates during web breaks.

SUMMARY OF THE INVENTION

The invention is intended to improve the separation of impurities in the machine circulation of a coating or sizing station and particularly to improve the separation of fibrous materials.

The invention is based on at least part of the coating, sizing mixture, or other processing agent being led from the processing station through a sieve beneath the station, with the aid of the pressure arising from the difference in height between the station and the sieve.

Considerable advantages are gained with the aid of the invention.

The advantage of this is, among others, the possibility to freely reject, wash, and service the sieve without disturbing coating, because the sieve is on the return side of the coating station, so that bypassing it will not disturb the operation of the station. In addition, there are usually several sieves in parallel, so that one sieve at a time can be taken for servicing, in which case the amount of bypassing mixture is only part of the total flow. Because blockage of the sieve will not interrupt the operation of the station and the pressure over the sieve is low, it is possible to use finer sieving than one could otherwise dare to use on the feed side. Automatic washing of the sieves can also be arranged easily. The actual sieving process is very simple. The maximum pressure difference arising from the difference in height is so small that it cannot break the sieve drum, which is a danger when feeding with a powerful pump. If the sieve is located according to the accompanying diagram on the lower circulation side, the sieve can be easily emptied and the processing-agent mixture collected in the machine reservoir while the sieve is washed. When the sieve bypass valve is opened and the feed valve closed, the sieve will empty through the accept. Emptying is assisted by the suction created in the sieve by the return flow. The return pipe of the coating station is full nearly as far as the station, thus avoiding the layers of sediment that typically form in the return pipe.

A lower pressure than on the feed side of the station may improve the fiber separation ability of the sieve. However, the most important feature that improves the fiber separation ability is the fact that perforated-plate sieves can be advantageously used on the return side. Elongated fibers will pass through a gap sieve with reasonable ease when they turn in the direction of the gap. When using a perforated plate as the separating element, the fibers travel on the other hand mainly transversely to the hole and cannot penetrate through the plate. Fibers that detach from the wires, felts, and the actual web of a paper or board machine are a great problem in sieving on the feed side of a coating station, because they block the gap sieve by winding themselves around the sieve wire. This causes a need for servicing and breaks in production. If the fibrous impurities are removed by the sieving method according to the invention, sieves with a greater penetrability can be used on the feed side of the coating station and the frequency of blocking of the sieves will be substantially reduced. Further, the feed-side reject can be led to the return side through sieves, in which case the amount of waste will decrease. This is important in terms of the mill's water-treatment capacity.

In the following, the invention is examined with the aid of examples and with reference to the accompanying drawing.

DESCRIPTION OF THE PREFERRED EMBODIMENTS

Figure 1:
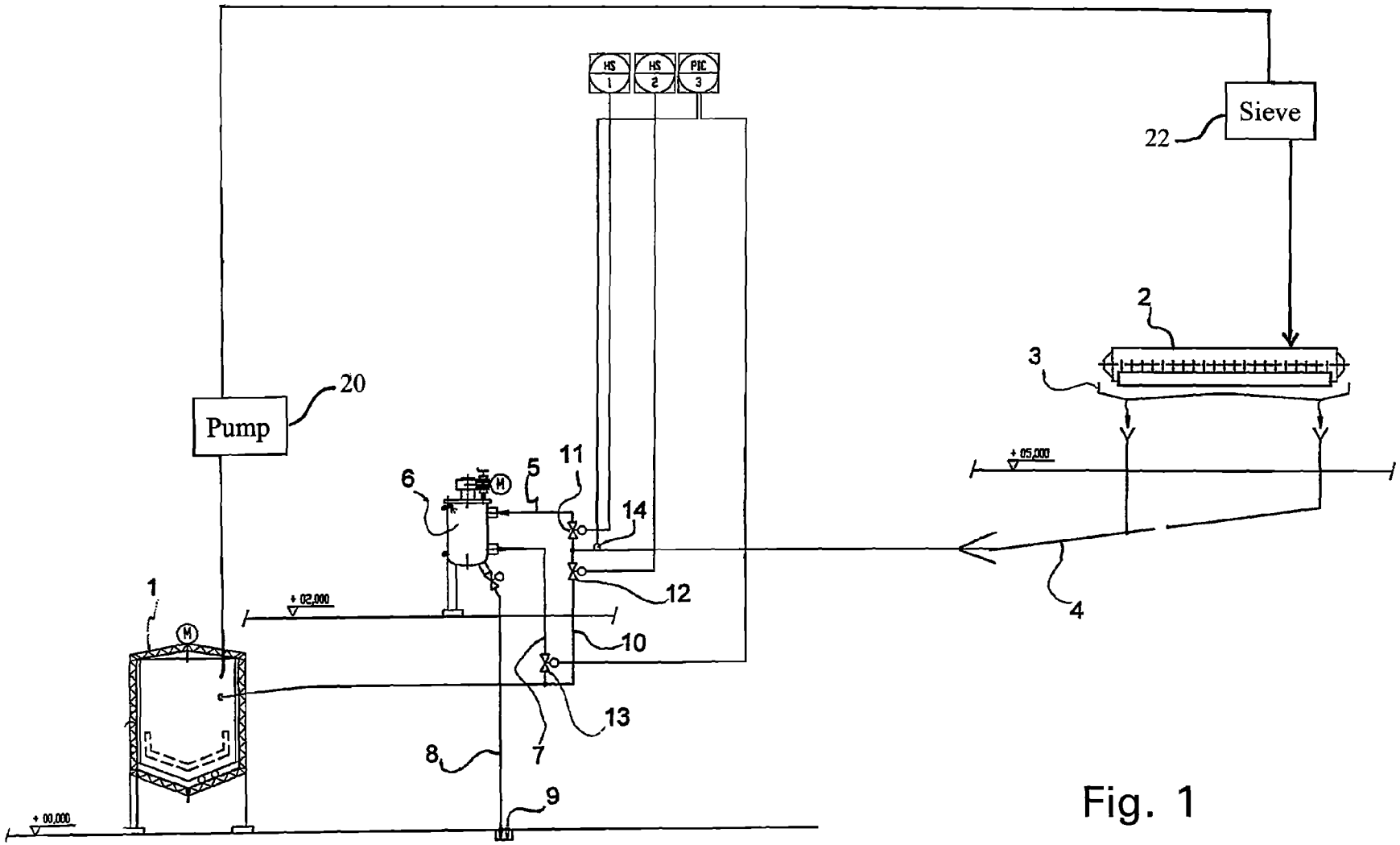
FIG. 1 shows one sieving arrangement according to the invention.

In the following text, a processing station intended for processing paper or board will be referred to as a station. This station can be, for example, a station intended for pigment coating or a sizing station. The invention can be applied to all stations that have a return flow and by means of which substances generally used in the manufacture of paper and board are processed.

In this process a pump is not used, instead the pressure difference required by the sieving is created by the difference in height between the sieve and the reservoir of the station. The sieve is located above the surface of the machine reservoir. The hydrostatic pressure arising from the difference in height is sufficient for the sieving of return sieving using a pressure sieve.

The diagram shown in FIG. 1 depicts one embodiment of the invention. The diagram has been simplified, so that only the components of the system that are essential in terms of the invention are shown. The processing-agent mixture is in the machine reservoir 1, from where the mixture is pumped to the coating station 2. On the feed side, pumping with a pump 20 and sieving with a sieve 22 that is of a conventionally known kind, but it would, however, be preferable to use a sieve with a greater permeability. Because the sieving of the return flow effectively removes fibrous impurities, the task of the sieves on the feed side is only to ensure that compacted coating or similar particulate impurities do not reach the station. In principle, the sieving on the feed side can even be omitted. The construction of the feed side is shown schematically in FIG. 1, and is not referred to in greater detail in this description, because it does not affect the application of the invention.

The station 2 is located at a height of more than 5 meters and the circulating processing-agent mixture is collected in the station's collector pan 3, from where is it led along the return line 4 to one or more sieves 6. The sieve 6 is located lower than the station, at a height of 2 meters. In the sieve, a feed connection 5 and accept connection 7 are connected to the return line 4, and lead to the machine reservoir, which is at the lowest level of 0 meters in the system. The sieve 6 is thus located, in the vertical direction, between the station and the machine reservoir, in such a way that the sieve is below the station and above the level of the agent surface in the reservoir. The actual height and location of the sieve are otherwise of no significance, as long as sufficient differences in height are created between the station and the sieve and the reservoir to feed the processing agent through the sieve and to the reservoir without pumps. The reject connection 8 of the sieve is led to an exit channel 9, through which the removed material goes to the treatment plant. A branch 10 leaves the return line 4 and is connection to the accept connection 7. The feed connection 5, the accept connection 7, and the branch 10 are equipped with remotely controlled valves 11, 12, 13. In addition, there is a pressure sensor 14 in the return line 4, which is connected through a regulator PIC3 to the valve 13 of the accept connection 7.

The arrangement operates as follows. The sieve 6 starts when the upper-circulation flow of the station 2 starts. Processing-agent mixture now begins to flow to the return line 4. The pressure-retention valve 13 after the sieve 6 in the accept line 7 regulates the pressure in the return line 4 and the sieve 6, in such a way that the sieve and the return pipe are filled. After filling, the pressure-retention valve 13 keeps the return line 4, which is controlled by the regulator PIC3 and the pressure sensor, full. After the filling of the return line 4 and the sieve 6, the accept of the sieve is led to the machine reservoir. The air-bleed line of the sieve acts as an "overflow", if the pressure difference in the sieve increases. The sieve can be emptied into the machine reservoir and washed at any time, either at regular intervals, or else due to an increase in pressure caused by a blockage. The valve 11 in the feed connection 5 is then closed, when the sieve empties and can be serviced and washed. If the sieve 6 must be serviced when the station is operating, the valve 12 in the branch 10 can be opened and the valve 11 of the feed connection closed, when the processing-agent flow will run directly to the machine reservoir. During a shutdown, the substance being sieved is collected in the machine reservoir and the sieve is filled with water, to prevent drying.

Within the scope of the invention, embodiments of the invention differing from those disclosed above can also be envisaged. The sieve or sieves on the return side should preferably be perforated drum pressure sieves. However, it can be envisaged for gap-drum sieves to be used instead of them, though in that case most of the fiber-separation capacity would be lost. The connections and valves controls and pipe runs of the actual sieves naturally depend on how the arrangement must be implemented in the mill. In principle, a feed pump can be used in the return line, for example, if only a small difference in height can be arranged between the station and the sieve or if the return line becomes long. In that case too, the pressure in the lines and in the sieves can be kept low, because the pump need not be used to create a feed pressure upwards against a difference in height. Correspondingly, a transfer pump can be used between the sieve and the machine reservoir.

The feed pressure through the sieve 6 can also be created in part or in whole as a suction pressure developed by flowing some or all of the processing agent to a reservoir at a lower height than the sieve 6, such as the machine reservoir 1 as shown in FIG. 1.

The invention claimed is:

1. A method for separating impurities from a machine circulation, of a flow of processing agent mixture used in a processing station to coat a paper or board web, the method comprising the steps of:

pumping the flow of the processing agent from a reservoir at a first level through a gap-drum pressure sieve and removing impurities from the processing agent in the gap-drum pressure sieve and hence to the processing station at a second level;

spreading at least a portion of the flow of processing agent on a surface of the paper or board web, coating the web and producing an excess flow of processing agent which leaves the processing station by a return pipe;

leading at least part of the excess flow of processing agent to pass through at least one perforated drum pressure sieve using a perforated plate as a separating element located at a third level between the first level, and the second level of the processing station at a feed pressure created at least in-part by a difference in height between the processing station and the perforated drum pressure sieve; and leading a flow from the at least one perforated drum pressure sieve of at least part of the excess flow of processing agent back to the reservoir.

2. The method of claim 1 wherein in the step of leading at least part of the excess flow of processing agent to the at least one perforated drum pressure sieve, the feed pressure is caused entirely by the difference in height between the processing station and the pressure sieve.

3. The method of claim 1, wherein in the step of leading at least part of the excess flow of processing agent to the at least one perforated drum pressure sieve, the feed pressure is created by a flow of processing agent coming from the sieve being led at least partly to the at least one reservoir at the first level, which is located below the level of the sieve, in such a way that at least part of the feed pressure of the processing agent to the sieve is created on the basis of the at least one reservoir at the first level being lower in height than the sieve.

4. The method of claim 1 further comprising the steps of:

measuring pressure before a valve regulating the flow from the perforated drum pressure sieve of at least part of the excess processing agent back to the reservoir; and regulating the flow from the perforated drum pressure sieve of the at least part of the excess processing agent back to the reservoir by controlling said flow with the valve based on the measured pressure in such a way that the perforated drum pressure sieve and the return pipe are filled.

5. A method for separating impurities from a machine circulation of a flow of processing agent used in a processing station to coat a paper or board web, the method comprising the steps of:

leading the flow of the processing agent from a reservoir at a first level with a pump through a gap sieve to the processing station at a second level;

spreading at least a portion of the flow of processing agent on the surface of a paper or board web, coating the web, and producing an excess flow of processing agent which leaves the processing station; and leading at least part of the excess flow of processing agent to at least one perforated drum pressure sieve using a perforated plate as a separating element at a third level between the first and second levels, wherein a flow of processing agent coming from the at least one perforated drum pressure sieve is led at least partly to at least one reservoir, which is located below the level of the perforated-drum pressure sieve in such a way that a feed pressure of the processing agent through the perforated drum pressure sieve is created entirely by the difference in height between the at least one reservoir and the at least one perforated-drum pressure sieve.

6. An arrangement in a paper or board machine for separating impurities from a machine circulation of a processing agent mixture in a coating or sizing station comprising:

a processing agent mixture reservoir positioned at a first level;

a pump in processing agent mixture receiving relation to the reservoir;

a gap-drum pressure sieve in processing agent mixture receiving relation to the pump;

a processing station positioned at a second level, in processing agent mixture receiving relation to the gap-drum pressure sieve, the processing station engaged in processing agent mixture spreading relation with a paper or board web, the processing station having a collector pan arranged to receive processing agent mixture; and at least one perforated-drum pressure sieve using a perforated plate as a separating element located at a third level between the second level and the first level, the perforated-drum pressure sieve positioned at a height difference below the level of the collector pan and connected in processing agent mixture receiving relation to the collector pan by a return pipe which connects to a branch line which leads to the at least one perforated-drum pressure sieve through a first valve, and to the processing agent mixture reservoir through a second valve, such that the height difference between the collector pan and the perforated-drum pressure sieve is arranged to create a feed pressure in the processing agent mixture supplied to the perforated-drum pressure sieve, wherein the at least one perforated-drum pressure sieve is in processing agent mixture supplying relation to the reservoir through a third valve; and a pressure sensor in the return pipe and a regulator connected to the sensor and the third valve in pressure regulating relation so that the pressure in the perforated-drum pressure sieve and the return pipe can be regulated so the perforated-drum pressure sieve and the return pipe are filled with processing agent mixture.

7. The arrangement of claim 6 wherein the height difference between the collector pan and the at least one perforated-drum pressure sieve is arranged so that a pressure difference created between them is sufficient to feed the processing agent mixture from the collector pan through the sieve.

8. The arrangement of claim 6, wherein the reservoir is located sufficiently below the at least one pressure sieve to feed processing agent mixture from the perforated-drum pressure sieve to the mixture reservoir.

9. A method of separating impurities from processing agent mixture recirculated from a sizing or coating station, the method comprising the steps of:

drawing coating from a reservoir with a pump and pumping the coating through a mechanically cleaned sieve having a sieving element in a closed pressurized vessel in which the coating travels through the sieving element from a higher pressure to a lower pressure, and passing the coating through a linear gap of about 75 μm to 150 μm defined between a triangular wire wound in a cylinder to a processing station and applying the coating to a board or paper web;

collecting coating which is doctored off the paper or board web in a collecting pan, and leading at least a portion of said collected coating through a return line to at least one perforated drum pressure sieve, located below the processing station, and separating fibers from said collected coating with a perforated plate forming a part of the perforated drum pressure sieve;

passing an accept fraction flow of the collected coating through a regulating valve to the reservoir; and regulating the accept fraction flow with a regulator based on the output of a pressure sensor in the return line before the at least one perforated drum pressure sieve in such a way that the sieve and the return pipe are filled.

10. The method of claim 9 further comprising creating a feed pressure applied to the at least one perforated drum pressure sieve entirely by the difference in height between the processing station and the at least one perforated drum pressure sieve.

11. The method of claim 9, wherein in the step of leading at least part of the collected coating to the at least one perforated drum pressure sieve further comprises creating a feed pressure applied to the at least one perforated drum pressure sieve at least in part by positioning the reservoir below the at least one perforated drum pressure screen.

12. A method of coating a paper web and controlling and processing a flow of processing agent, the method comprising the steps of:

pumping a flow of the processing agent with a pump from a machine reservoir at a first level to a cylinder wound from a single triangular wire, in which a gap for penetration is formed between the wire windings forming a gap sieve, and removing impurities from the processing agent in the gap sieve;

following the gap sieve supplying the processing agent to a coating station at a second level above the first level, and coating the paper web by spreading a portion of the flow of processing agent on a surface of the paper or board web, coating the web and producing an excess flow of processing agent;

collecting the excess flow of processing agent in a collector pan and leading the excess flow of processing agent by a return pipe to a branch line which leads to at least one perforated-drum sieve using a perforated plate as a separating element, through a first valve, and to the machine reservoir through a second valve, wherein the perforated-drum sieve is located on a third level between the second level and the first level;

wherein the first level, the second level, and the third level are arranged to create a pressure differential over the perforated-drum sieve sufficient to cause processing agent to pass through the perforated-drum sieve;

filtering the excess flow of processing agent through the perforated-plate of the perforated-drum sieve, the perforated-drum sieve having an accept side receiving processing agent which has passed through the perforated-plate, the accept side connected to the machine reservoir through a third valve; and measuring a pressure in the return pipe with a pressure sensor and regulating the third valve and thus the pressure in the perforated-plate sieve and the return pipe in such a way that the perforated-plate sieve and the return pipe are filled with processing agent.

13. The method of claim 12 further comprising the step of periodically closing the first valve, and opening the second valve and washing the perforated-drum sieve, while continuing to coat the paper web by pumping from the machine reservoir the processing agent which flows through the open second valve, and bypasses the perforated-drum sieve, followed by opening the first valve and closing the second valve to again lead the excess flow of processing agent through the perforated-drum sieve and then to the machine reservoir through the third valve.

14. The method of claim 12, wherein in the step of leading the excess flow of processing agent to the at least one perforated-drum sieve, the feed pressure is created in part by the flow of processing agent coming from the perforated-drum sieve being led to the machine reservoir, which is located below the level of the perforated-plate sieve.

* * * * *

UNITED STATES PATENT AND TRADEMARK OFFICE

CERTIFICATE OF CORRECTION

PATENT NO. : 7,887,872 B2
APPLICATION NO. : 11/575472
DATED : February 15, 2011
INVENTOR(S) : Viitanen et al.

It is certified that error appears in the above-identified patent and that said Letters Patent is hereby corrected as shown below:

On the Title page, Item [56] of the issued patent, the References Cited should include:

U.S. PATENT DOCUMENTS

--3,833,468 9/1974 Boniface ..... 162/264
5,401,899 3/1995 Bryant et al. ..... 118/603
6,074,700 6/2000 Roitto ..... 427/345
2002/0166647 A1 11 /2002 Attenberger et al.
2002/0134519 A1 9/2001 Karlsson et al.
2003/0041990 A1 3/2003 Munchow--

FOREIGN PATENT DOCUMENTS

--DE 10260593 A1 7/2004
FI 103290 B 5/1999
WO 95/04189 A1 2/1995
WO 03/059528 A1 7/2003
WO 2006/032722 A1 3/2006--

OTHER PUBLICATIONS

--Search Report issued in PCT/FI2005/00395
English translation of Abstract of DE 10260593--

Signed and Sealed this
Fourteenth Day of February, 2012

David J. Kappos

David J. Kappos
*Director of the United States Patent and Trademark Office*